US005479666A

United States Patent [19]

Foster et al.

[11] Patent Number: 5,479,666

[45] Date of Patent: Jan. 2, 1996

[54] FOOT EGRESS CHAIR BED

[75] Inventors: L. Dale Foster, Brookville; John W. Ruehl, Shelbyville, both of Ind.

[73] Assignee: Hill-Rom Company, Inc., Batesville, Ind.

[21] Appl. No.: 186,657

[22] Filed: Jan. 25, 1994

[51] Int. Cl.[6] ..... A61G 7/06

[52] U.S. Cl. ..... 5/624; 5/602; 5/618; 5/662; 297/423.3; 297/423.36

[58] Field of Search ..... 5/602, 617, 618, 5/624, 600, 662, 619; 297/423.2, 423.3, 423.36

[56] References Cited

U.S. PATENT DOCUMENTS

| | | | |
|---|---|---|---|
| 1,398,203 | 11/1921 | Schmidt . | |
| 2,308,592 | 1/1943 | Drexler et al. . | |
| 3,032,059 | 5/1962 | McLeod . | |
| 3,038,174 | 6/1962 | Brown et al. . | |
| 3,210,779 | 10/1965 | Herbold . | |
| 3,220,022 | 11/1965 | Nelson | 5/618 |
| 3,281,141 | 10/1966 | Smiley et al. . | |
| 3,593,350 | 7/1971 | Knight et al. . | |
| 4,139,917 | 2/1979 | Fenwick . | |
| 4,183,109 | 1/1980 | Howell | 5/618 |
| 4,227,269 | 10/1980 | Johnston . | |
| 4,639,954 | 2/1987 | Speed . | |
| 4,787,104 | 11/1988 | Grantham | 5/618 X |
| 4,862,529 | 9/1989 | Peck . | |
| 4,894,876 | 1/1990 | Fenwick . | |
| 4,987,620 | 1/1991 | Sharon . | |
| 5,072,463 | 12/1991 | Willis | 5/618 |
| 5,077,843 | 1/1992 | Foster et al. . | |
| 5,095,561 | 3/1992 | Green et al. | 5/618 |
| 5,157,800 | 10/1992 | Borders . | |
| 5,279,018 | 1/1994 | Ferrand et al. | 5/624 X |

FOREIGN PATENT DOCUMENTS

| | | | |
|---|---|---|---|
| 0178951 | 4/1896 | European Pat. Off. . | |
| 716981 | 2/1942 | Germany | 5/600 |
| 595097 | 9/1977 | Germany . | |

*Primary Examiner*—Michael F. Trettel
*Attorney, Agent, or Firm*—Barnes & Thornburg

[57] ABSTRACT

A hospital bed that is convertible to a chair for patient egress from the foot end of the bed. A patient support platform has serially hinged, normally horizontal head, seat, thigh and foot panels. To convert the horizontal bed to the chair configuration, the patient support platform in the lowermost vertical position is translated longitudinally toward the foot end of the bed. The head panel is pivoted upwardly and the foot panel pivots downwardly to a generally vertical attitude. The foot panel includes a collapsing portion which telescopes into a pivoting portion to thereby avoid interference with the floor as the foot panel is pivoted to a vertical attitude. When converted to the chair configuration, an area is vacated at the foot end of the bed to provide a space for docking a wheelchair or other ambulatory assisting device. The patient's feet rest directly on the floor in the chair configuration in that the foot panel collapses into itself as it pivots downwardly rather than pivoting along a second axis to underlie the patient's feet.

48 Claims, 7 Drawing Sheets

FOOT EGRESS CHAIR BED

FIELD OF THE INVENTION

This invention relates to a hospital bed that is convertible to a chair. The structure of the present invention is primarily useful for facilitating getting a patient from a supine position on the bed to a standing and/or walking position or into a wheelchair or other ambulatory assisting device.

BACKGROUND OF THE INVENTION

In the present practice, two nurses or other health care providers are preferably employed in assisting a patient in moving from a supine position to a standing position. This is particularly true for a patient who has been in the supine position for a long period of time. In many instances, the patient in that condition simply does not want to stand because it is painful.

To get the patient to a standing position, the bed is lowered and the side rails of the bed are dropped. The patient is then pivoted or swung through approximately 90° so that the patient's legs hang over the side of the bed. Even with the bed in a lowered position, the patient's feet likely will not rest firmly on the floor. Therefore, in addition to experiencing discomfort or pain, the patient is apprehensive about sliding off the bed without knowing when his feet will touch the floor.

In this situation, the health care providers assist the patient in getting his feet on the floor as he slides off the bed. The attendants are unable to lift the patient directly since they are at the edge of the bed and the patient's weight is centered inward of the edge of the bed. If the patient should start to fall, the attendants must hold the patient firmly while at the same time bracing themselves in a somewhat awkward position. The resulting situation is potentially injurious not only for the patient, but for the attendants as well.

One prior solution to this problem is disclosed in U.S. Pat. No. 4,862,529 and assigned to the assignee of the present invention. That patent discloses a bed which is convertible to a chair and has a retracting frame mounted on a fixed frame. A patient support surface is formed by serially connected panels with a seat panel being fixed to the retracting frame. Movement of the retracting frame toward the foot end of the bed causes a head panel to rise and a leg panel to drop, thereby creating a chair configuration. A foot panel of the bed underlies the patient's feet when in the chair position. As a result, a so-called "false floor" is created for the patient's feet, thereby preventing the patient from placing his feet directly on the floor to exit to stand and exit the bed. Likewise, the position of the foot panel in the chair configuration blocks access to patient and bed and prevents easily transferring the patient from the bed to a wheelchair or other ambulatory assisting device.

Another potential solution can be found in so-called birthing beds. In these beds, for example, U.S. Pat. No. 5,157,800 also assigned to the assignee of the present invention, the foot section of the bed is totally removed from the bed for delivery purposes. While such a technique could be employed in beds convertible to chairs so as to provide direct access to the floor by a patient's feet, such a design requires removal, storage and replacement of the foot section.

Therefore there has been a need for a bed which converts to a chair, which lowers relatively close to the floor so that a patient's feet contact the floor while still seated in the chair bed, which does not have the foot section of the bed underlying the patient's feet, and which does not require the foot section of the bed to be removed.

BRIEF DESCRIPTION OF THE INVENTION

One objective of this invention has been to provide a hospital bed convertible to a chair which permits the patient to conveniently exit the bed from the foot end thereof.

Another objective of the invention has been to provide a bed convertible to a chair in which the patient's feet contact the floor directly when exiting the bed in the chair configuration.

Yet another objective of this invention has been to provide a hospital bed convertible to a chair in which an area at the foot end of the bed is vacated in the chair configuration to provide a space for docking a wheelchair or other ambulatory assisting device.

These and other objectives of the invention are attained by providing a hospital bed with a frame mounted on a base and a patient support platform mounted on the frame. The platform is provided with a series of interconnected head, seat, thigh and foot panels which are hinged at their respective interfaces.

The bed of the present invention does not have a panel or any other structure underlying the patient's feet when it is in the chair configuration, unlike many prior beds which are convertible to chairs. A patient's feet rest directly on the floor surface when the bed is converted to the chair configuration, thereby avoiding patient insecurity or the inconvenience associated with a "false floor" effect. Further, an area is vacated at the foot end of the bed in the chair configuration to provide space for docking a wheelchair, motorized scooter, motorized walker, exerciser or other patient therapy/rehabilitation apparatus. This is accomplished without however physically removing the foot section of the patient support from the bed.

To accomplish this, the patient support platform and panels translate longitudinally with respect to the hospital bed frame. The patient support platform is movable longitudinally relative to the bed base by a hydraulic cylinder. The seat panel moves atop the bed frame by rollers mounted to and underlying the seat panel.

In converting the bed to the chair configuration, the patient support platform is lowered to a lowermost position and then translated toward the foot end of the bed. The foot panel pivots downwardly to a generally vertical attitude rather than pivoting along a second axis to underlie the patient's feet. A portion of the foot support panel collapses into itself as the panel pivots downwardly, thereby providing space at the foot end of the bed. A central section of the foot panel includes a pivoting portion and a collapsing portion which telescopes into and out of the pivoting portion by approximately 13 inches. The collapsing portion is smaller in cross-section than the pivoting portion to allow for telescoping, and is spring biased relative to the pivoting portion toward an extended position.

A pair of links pivotally connect the pivoting portion of the foot panel to the bed frame. Rollers are mounted on either side of the bed frame and under the lateral edges of the pivoting portion of the foot panel. Movement of the patient support platform with the hydraulic cylinder toward the foot end of the bed causes the pivoting portion of the foot panel to drop to a generally vertical position due to the connection of the foot end of the pivoting portion of the foot panel to the bed frame via the pivot links and the traveling fulcrum effect of the rollers underlying the pivoting portion.

As the pivoting portion of the foot panel pivots downwardly, a block rides against a roller underlying the foot panel which is connected to the head end of the collapsing portion. The block is moved away from the foot end of the foot panel to retract the collapsible portion into the pivoting portion of the foot panel. Movement of the patient support platform toward the head end of the bed moves the block toward the foot end of the bed. The collapsing portion is spring biased relative to the pivoting portion toward an outwardly extended position allowing the collapsing portion to project out of the pivoting portion.

A section of the bed frame underlying the foot panel is generally U-shaped with the open end of the U facing toward the foot end of the bed. A lateral section of the foot panel is pivotally connected to the thigh panel at its head end on each side of the central section. Each lateral section of the foot panel is supported by one of the arms of the U-shaped section of the bed frame. As a result, the lateral sections of the foot panel can pivot relative to the thigh panel as is required if the thigh panel is pivoted upwardly relative to the seat panel. But the foot end of the lateral sections of the foot panel remain atop the arms of the U-shaped frame section and do not pivot downwardly through the frame as does the central section of the foot panel.

A pivoting footboard is mounted at the outer end of each arm of the U-shaped frame section. Each footboard can be outfitted with the various controls which are currently offered on existing hospital bed footboards. The footboards function as a typical footboard when pivoted to be generally collinear with each other at the foot end edge of the bed in an end-to-end configuration. When each footboard is pivoted approximately 90° so that it is generally parallel with the other and positioned at the respective lateral edge of the bed, it can be used as a handhold for the patient seated atop the patient support platform. When in the chair position, the footboards as handholds aid the patient in rising from a seated position to a standing position and vice versa. In addition, the pivoting feature of the footboards allows for the entire foot section defined by the U-shaped section of the frame to be evacuated for docking therapy/rehabilitation accessories to the bed.

To assist the patient from exiting the bed of this invention in the chair position, a patient lift mechanism is provided. The patient lift mechanism raises the patient support platform to aid the patient in standing or exiting the bed. The patient lift mechanism includes a four bar linkage connecting the frame to the base and a hydraulic cylinder connected to the linkage and the base.

Additionally, the bed of this invention can be utilized in other applications, as for example, a birthing bed in which case the lateral sections of the foot panel would include stirrups.

BRIEF DESCRIPTION OF THE DRAWINGS

The several features of the invention will become more readily apparent from the following detailed description taken in conjunction with the accompanying drawings in which.

DETAILED DESCRIPTION OF THE INVENTION

Figure 1:
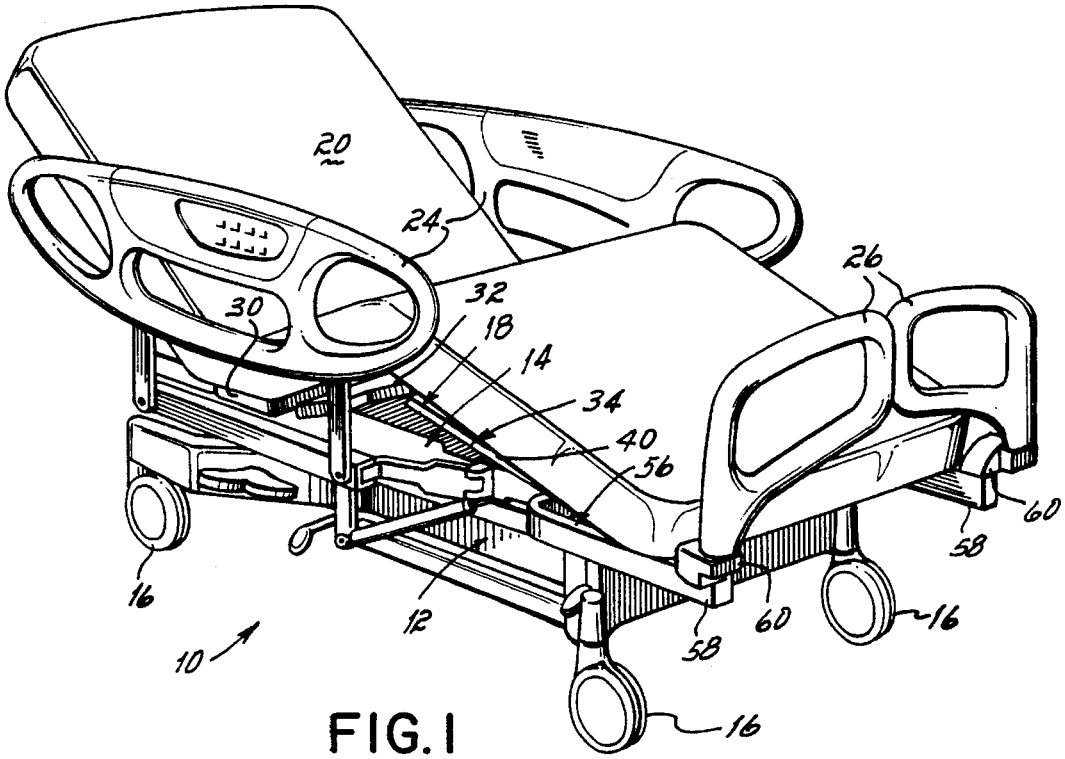
FIG. 1 is a perspective view of a hospital bed according to the present invention.

Referring to FIG. 1, a hospital bed 10 has a base 12 and a frame 14 mounted on the base 12. The hospital bed 10 has castors 16 for movement of the bed 10 about the hospital. The bed 10 has a patient support platform 18 underlying a mattress 20 on which a patient 22 is situated. At least a portion of the mattress 20 is preferably inflated. The hospital bed 10 has patient side guards 24 and foot guards 26 for protection of the patient 22 situated atop the bed 10.

Figure 2:
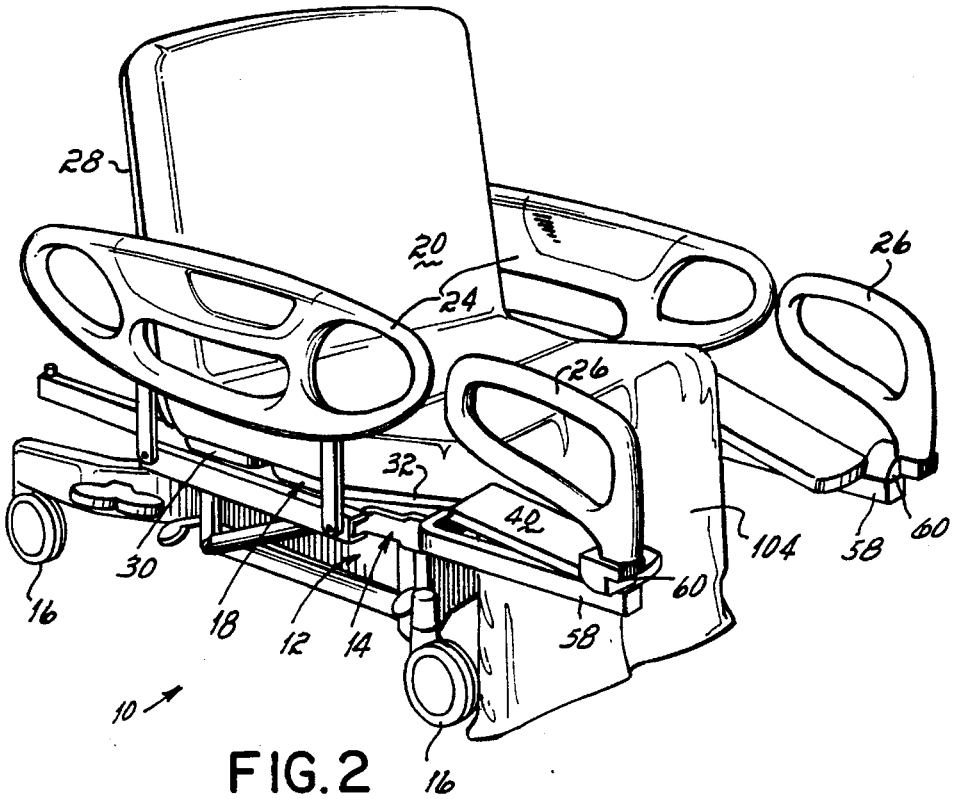
FIG. 2 is a perspective view of the hospital bed in a chair configuration.
Figures 3, 5:
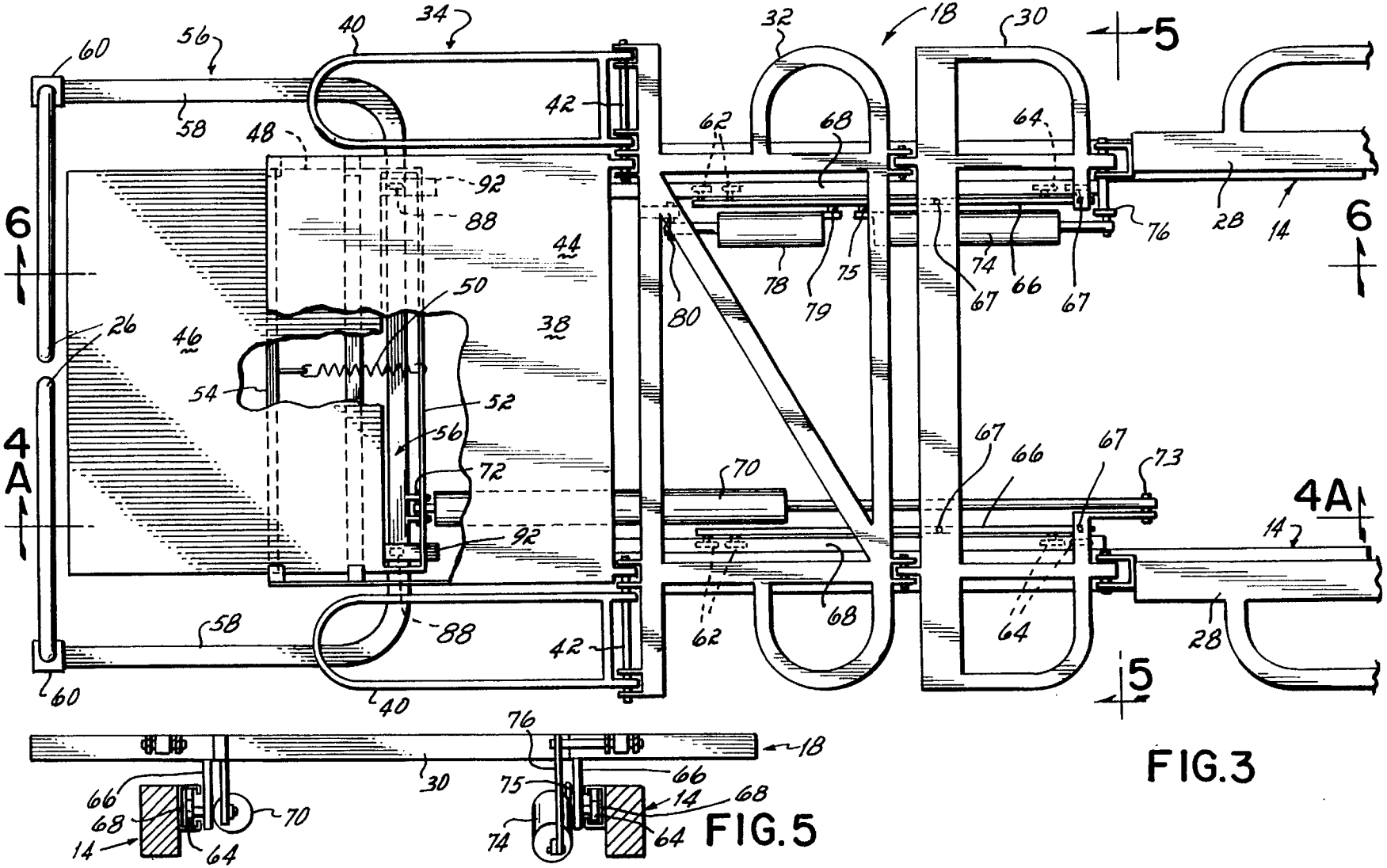
FIG. 3 is a top plan view of a portion of the patient support platform in the bed configuration.
FIG. 5 is a cross-sectional view taken along line 5—5 of FIG. 3.

The patient support platform 18 can be converted to and between a generally horizontal bed configuration and a chair configuration as shown in FIG. 2. The patient support platform 18 consists of serially hinged head 28, seat 30, thigh 32 and foot 34 panels. Each panel is pivotally attached to the adjoining panel as by pins or other suitable mechanisms well known in the art. The foot panel 34 consists of a central section 38 and a pair of lateral sections 40, 40, one of which is pivotally mounted to the thigh panel 32 on each lateral side of the central section 38 as by a pin or bar 42 as shown in FIG. 3. The central section 38 of the foot panel 34 consists of a pivoting portion 44 which is likewise pinned to the thigh panel 32 by the bar or pin 42 and a collapsing portion 46 which is smaller in cross-section than the pivoting portion 44 for telescoping into and out of a cavity 48 within the pivoting portion 44. The collapsing portion 46 is biased by a spring 50 connected at a first end to a crossbar 52 secured to the collapsing portion 46 and at a second end to a crossbar 54 secured to and underlying the pivoting portion 44. In a preferred embodiment of this invention, the collapsing portion 46 extends approximately 13 inches out of the pivoting portion 44 of the foot panel 34 in the bed configuration.

The frame 14 of the bed 10 includes a U-shaped frame section 56 at the foot end of the bed 10. The U-shaped frame section 56 is open toward the foot end of the bed 10 and includes a pair of arms 58, 58 to which one of each of the foot guards 26, 26 is pivotally 15 mounted at a terminal end 60 thereof. With the patient support platform 18 in the bed configuration, the foot guards 26 are generally collinear with each other and positioned at the foot end edge of the bed 10 for protection of the patient 22 as shown in FIGS. 1 and 3. In the chair configuration, each foot guard 26 can be pivoted approximately 90° to be positioned at the lateral side of the bed 10 to be generally parallel with each other as shown in FIG. 2. The foot guards 26, 26 in this position can be easily grasped as a handhold by the patient 22 exiting the foot end of the bed 10 in the chair configuration.

Figure 4A:
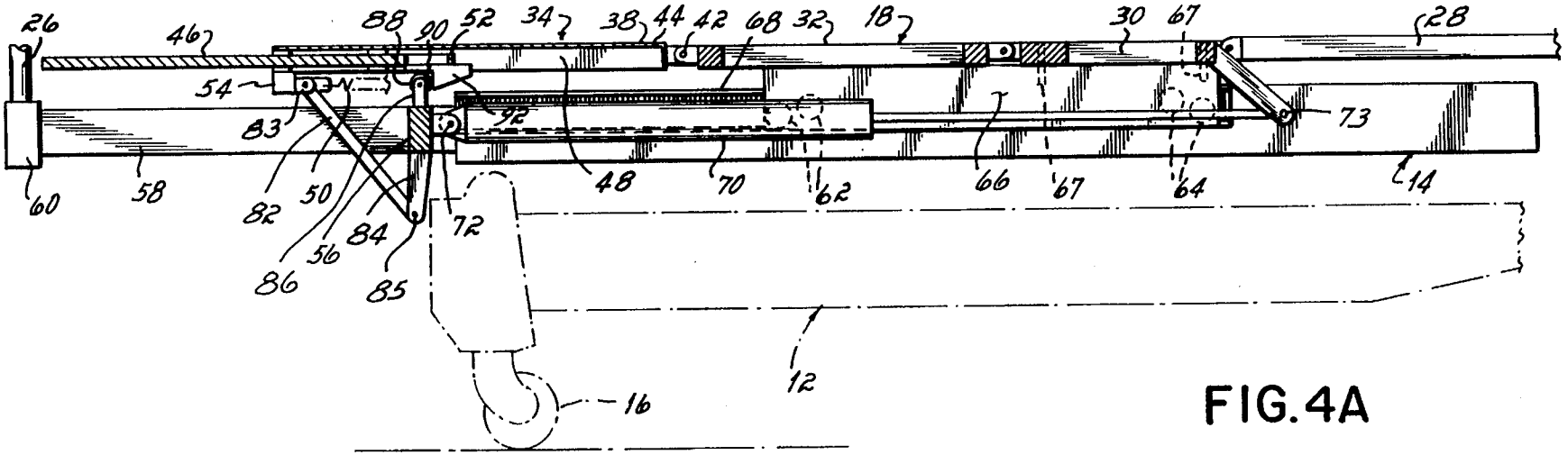
FIG. 4A is a cross-sectional view taken along line 4A—4A of FIG. 3.

The patient support platform 18 is movable longitudinally relative to the frame 14. A pair of forward 62, 62 and a pair of aft 64, 64 rollers are rotatably mounted to a roller bar 66 which is fixedly secured by pins 67 to the seat panel 30 on each side of the bed 10 as shown in FIGS. 3, 4A and 5. The roller pairs 62, 64 are housed and contained for rolling movement within a C-shaped channel 68 secured to the frame 14.

Figure 6:
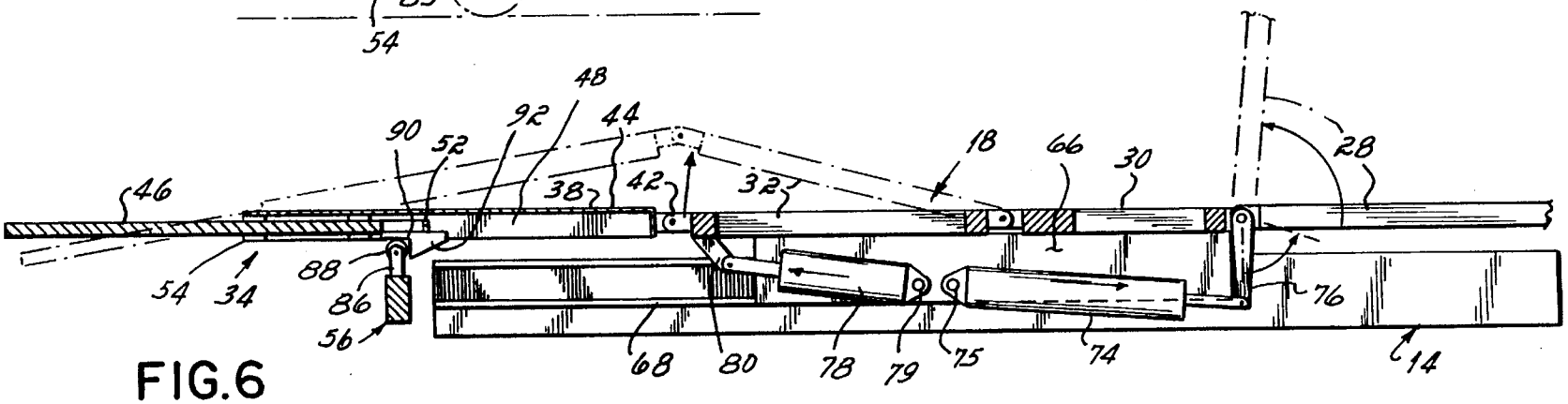
FIG. 6 is a cross-sectional view taken along line 6—6 of FIG. 3.

To assist the platform 18 in longitudinally moving relative to the frame 14, a first hydraulic cylinder 70 is pivotally connected as by a pin 72 to the U-shaped frame section 56 and at a second end by a pin 73 to the seat panel 30. A second hydraulic cylinder 74 is pivotally connected as by a pin 75 at a first end to the roller bar 66 and secured via a link 76 at a second end to the foot end of the head panel 28. The second hydraulic cylinder 74 is operational to pivot the head panel 28 from a generally horizontal bed configuration upwardly to an upright chair configuration as shown in FIG. 6. A third hydraulic cylinder 78 is pivotally joined at a first end by a pin 79 to the roller bar 66 and secured at a second end to a link 80 at the foot end of the thigh panel 32. The third hydraulic cylinder 78 is operational to pivot the interface between the thigh panel 32 and the foot panel 34 upwardly while converting the hospital bed 10 into the chair position.

Figure 4B:
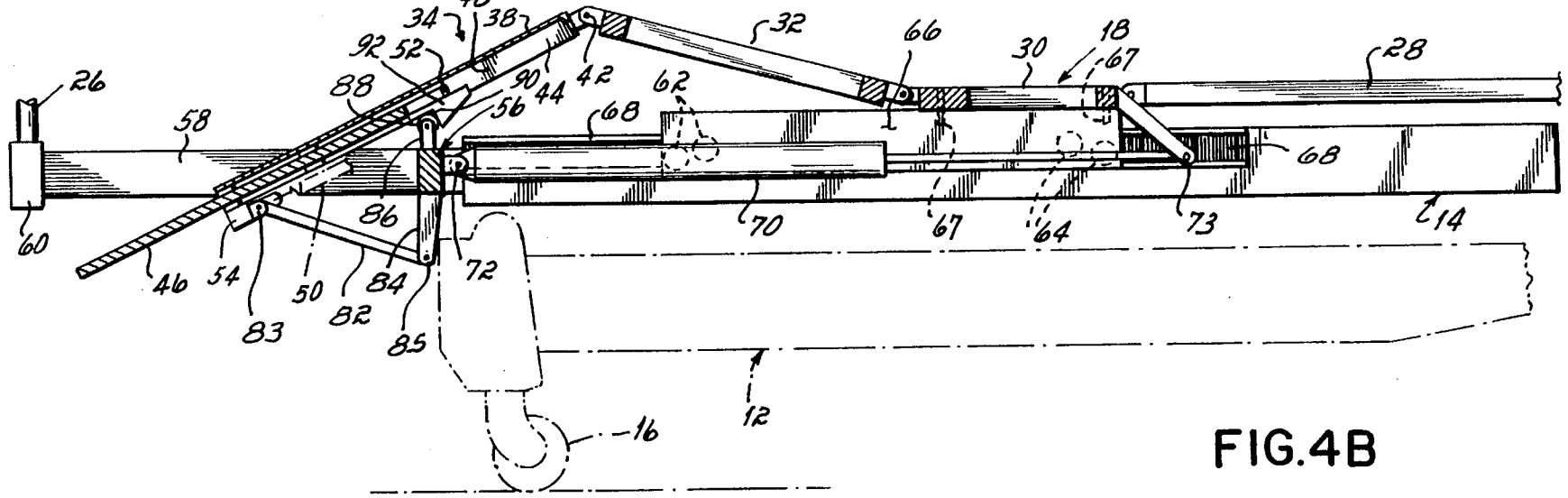
FIGS. 4B and 4C are views similar to FIG. 4A showing the hospital bed converting to the chair configuration.
Figure 4C:
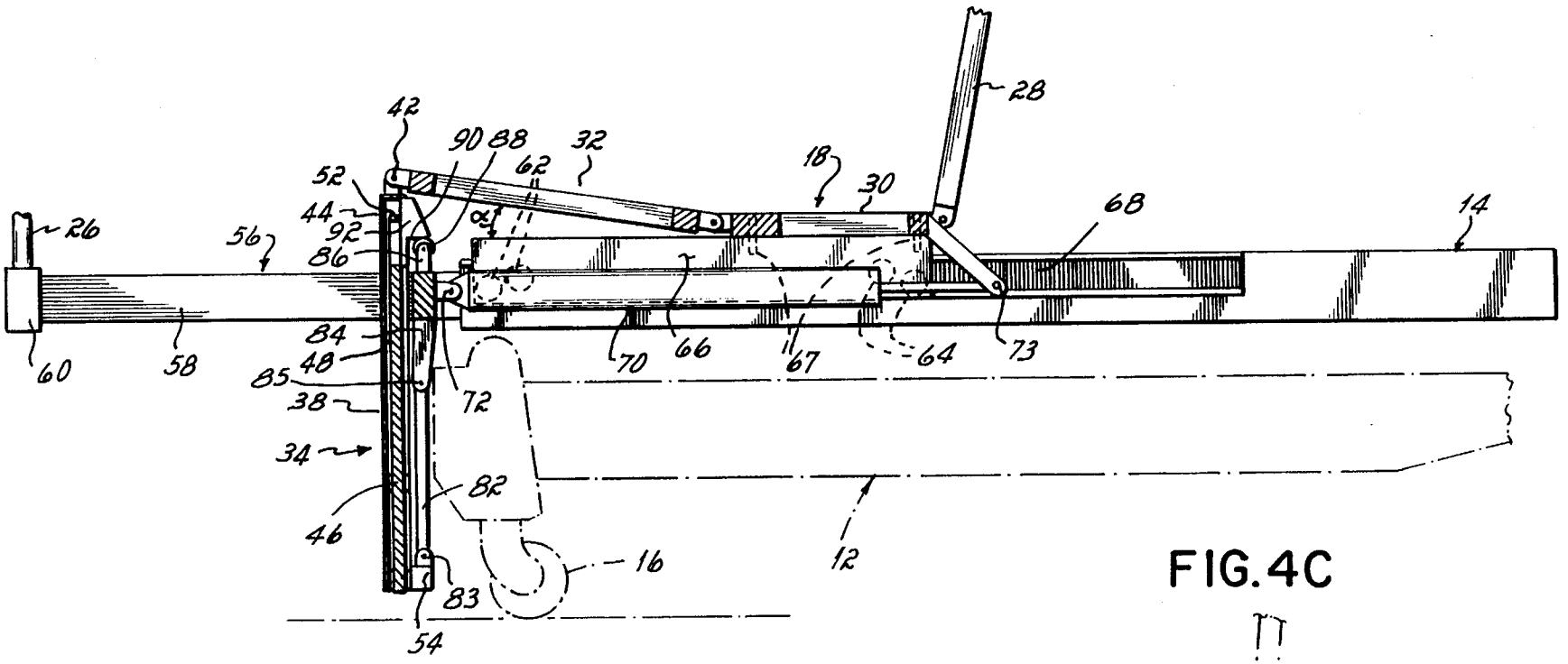

As shown in FIGS. 2 and 4C, the foot panel 34 is generally vertical with the bed 10 in the chair position. To avoid interference between and contact with the foot panel 34 and the floor as the foot panel 34 pivots downwardly, the collapsing portion 46 of the central section 38 of the foot panel 34 retracts into the pivoting portion 44 through the operation of a pair of links 82, 84 connecting the foot panel 34 to the bed frame 14 as shown in FIGS. 4A–C. The first link 82 is pivotally joined as by a pin 83 at a first end to the bar 52 secured to the underneath side of the pivoting portion 44 of the foot panel 34. A second end of the first link 82 is pivotally joined as by a pin 85 to a terminal end of the second link 84 projecting downwardly from the U-shaped frame section 56. A pair of posts 86, 86 each having a roller 88 rotationally mounted at an upper end thereof projects from the upper side of the U-shaped frame section 56. Each roller 88 is seated within a notch 90 of each of a pair of blocks 92, 92 secured to the underside of the collapsing portion 46.

The bed 10 of this invention is also equipped with a patient lift mechanism 94 as shown in FIGS. 8A, 8B, 9A and 9B for assisting the patient 22 in exiting the bed 10 from the chair position. The lift mechanism 94 includes a four bar linkage 96 having a pair of generally vertical links 98, 98 and a pair of longitudinal links 100, 101. The four bar linkage 96 is connected to the base 12 and the frame 14 of the bed 10 with a fourth hydraulic cylinder 102 pivotally joined to the middle portion of the upper longitudinal link 100 and the base 12.

To enable the patient 22 egress from the hospital bed 10 in the chair configuration, a portion 104 of the mattress 20 overlying the foot panel 34 can be collapsed or deflated as shown in FIG. 2, 9A, 10C and 10D.

Figure 10A:
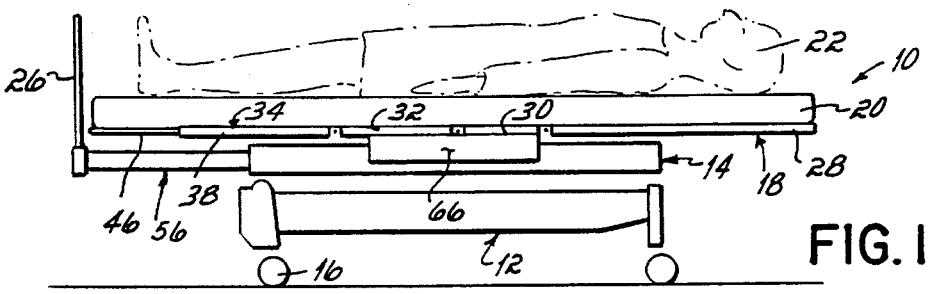
FIGS. 10A through 10D are schematic side views of the bed and patient converting from the generally horizontal bed position to the chair position for egress from the bed of this invention.
Figure 10B:
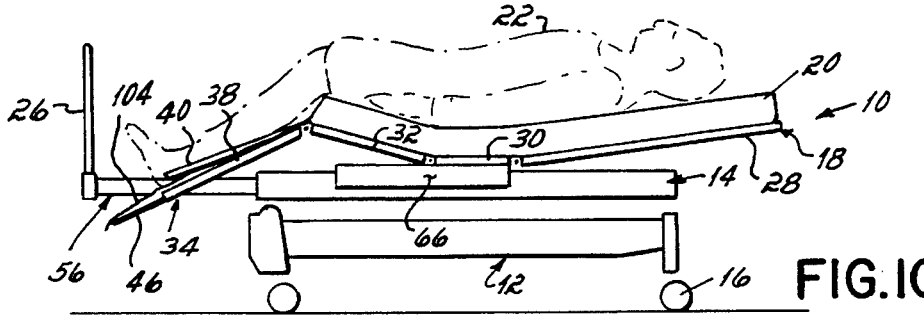
Figure 10C:
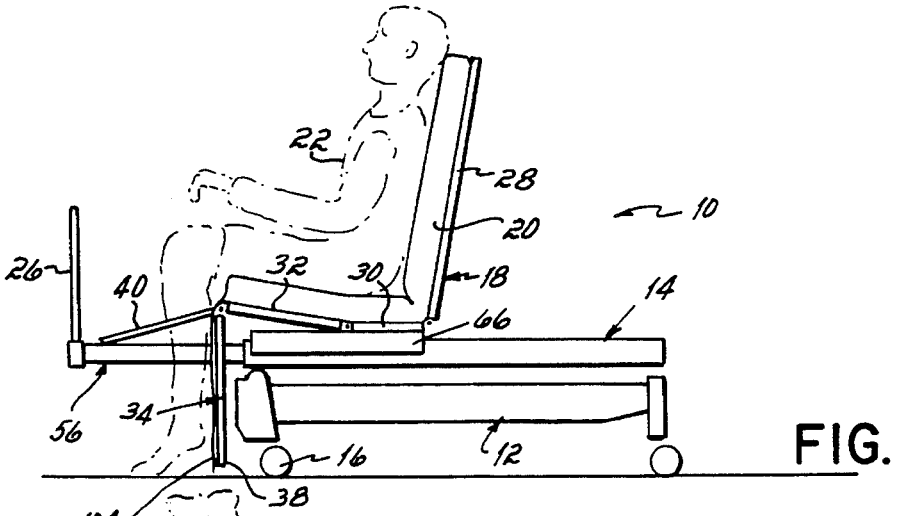
Figure 10D:
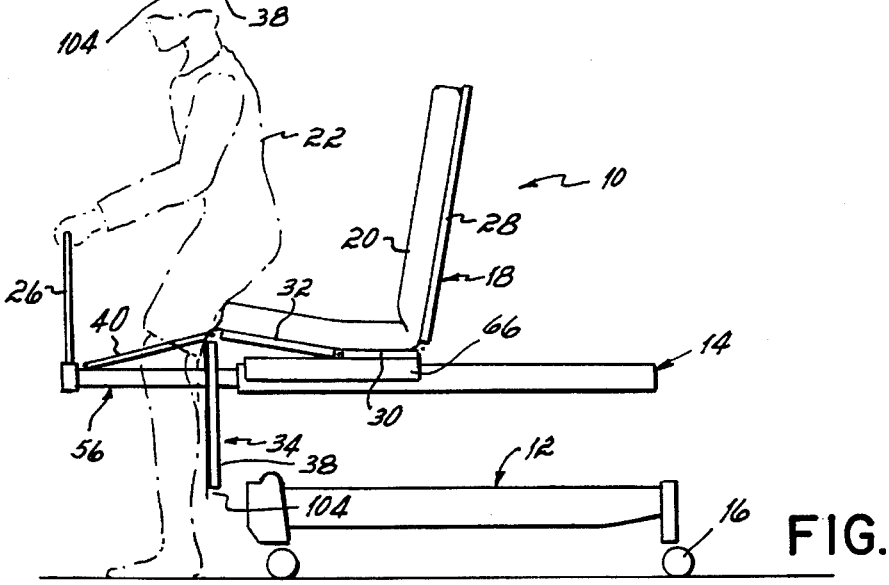

The conversion of the bed 10 of this invention from the bed position to the chair position is shown schematically in FIGS. 10A through 10D. The patient 22 is in a supine position atop the mattress 20 with the patient support platform 18 generally horizontal in the lowermost vertical position (FIG. 10A). The foot end portion 104 of the mattress 20 begins to deflate as the patient support platform 18 shifts longitudinally relative to the frame 14 toward the foot end of the bed 10 (FIG. 10B). Additionally, the head panel 28 pivots upwardly and the interface between the thigh panel 32 and the foot panel 34 pivots upwardly. With the foot panel 34 generally vertical and the collapsing portion 46 retracted into the pivoting portion 44, the patient 22 achieves a sitting position with his feet contacting the floor directly (FIG. 10C). The patient 22 is assisted in standing as the frame 14 elevates relative to the base 12 (FIG. 10D).

Figure 8A:
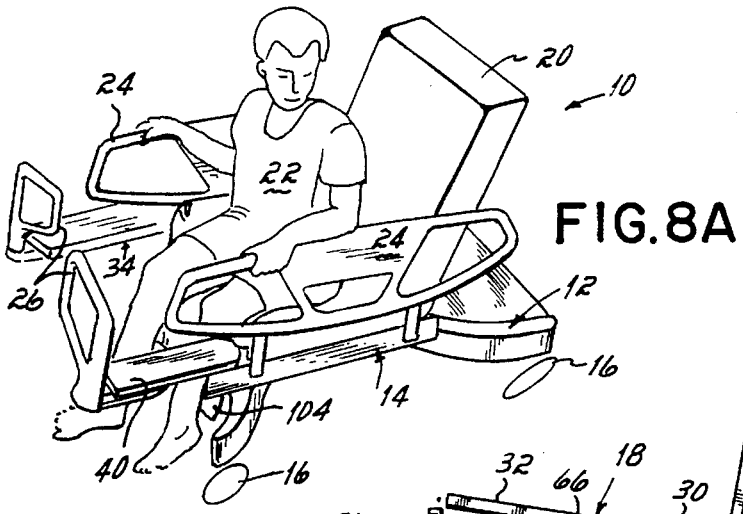
FIGS. 8A and 8B are a schematic perspective and a crosssectional side view, respectively, of the bed of this invention in the chair configuration showing the patient lift mechanism.
Figure 8B:
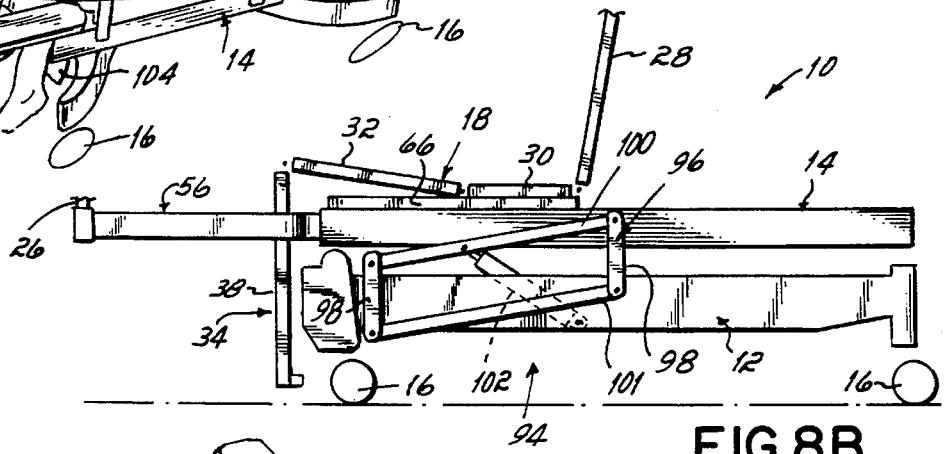

In operation, to convert the bed 10 of this invention from the generally horizontal bed configuration to the chair configuration and thereby permit the patient 22 egress from the foot end thereof, the patient support platform 18 is lowered vertically to the lowermost position as shown in FIG. 8B. This can be accomplished by retraction of the fourth hydraulic cylinder 102 thereby collapsing the four bar linkage 96.

The patient support platform 18 is translated longitudinally toward the foot end of the bed 10 by the retraction of the first hydraulic cylinder 70 (FIG.2). The rollers 62, 64 secured to the seat panel 30 roll within the C-shaped channel 68 secured to the frame 14. As the platform 18 rolls toward the foot end of the bed 10, the third hydraulic cylinder 78 extends (FIG. 6) to thereby elevate and pivot upwardly the interface between the thigh panel 32 and foot panel 34 by about 5° as shown by the angle $\alpha$ (FIG. 4C). The second hydraulic cylinder 74 extends to pivot the head panel 28 upwardly.

Figure 7:
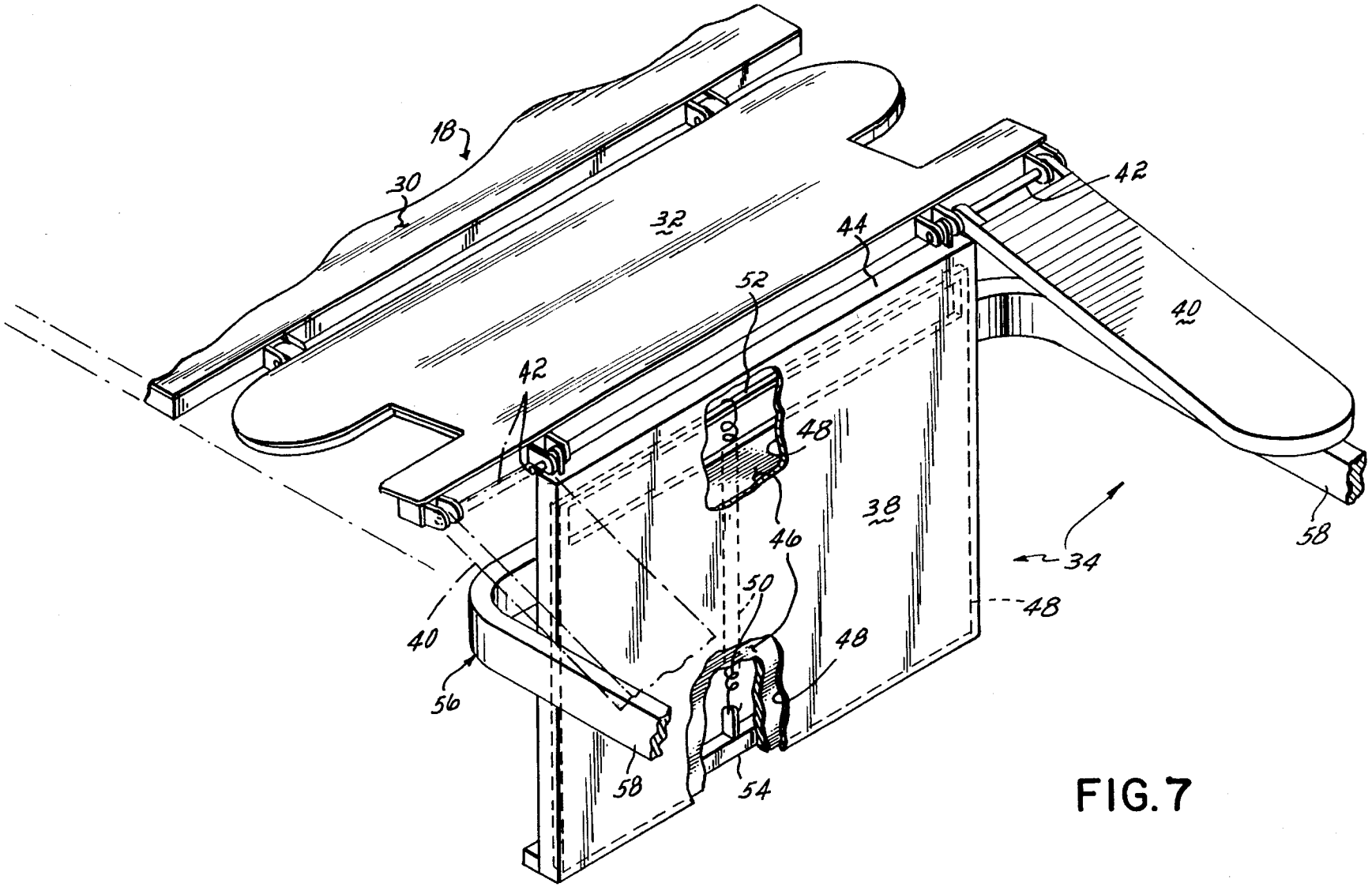
FIG. 7 is a perspective view of the foot end portion of the bed in the chair configuration showing the central section of the foot panel partially broken away.

As the interface between the thigh panel 32 and the foot panel 34 pivots upwardly, the foot end of the foot panel 34 pivots downwardly with the roller 88 extending from the post 86 acting as a fulcrum point enabling the block 92 and foot panel 34 secured thereto to pivot around the roller 88 as shown in FIGS. 4A–C. As the central section 38 of the foot panel 34 drops to the vertical attitude and the interface between the foot panel 34 and the thigh panel 32 pivots upwardly relative to the frame 18, the head end of the lateral sections 40, 40 of the foot panel 34 also pivot upwardly. However, the lateral sections 40, 40 do not drop below the frame 18 like the central section 38 because the lateral sections 40, 40 are supported by the arms 58, 58 of the U-shaped frame section 56 as shown in FIG. 7.

The collapsing portion 46 of the foot panel 34 is biased by the spring 50 toward the outwardly extended bed configuration shown in FIG. 4A. As the foot panel 34 pivots downwardly and the block 92 rotates about the roller 88, the foot end of the pivoting portion 44 of the foot panel 34 pivots downwardly away from the frame 18 thereby extending the spring 50 and retracting the collapsing portion 46 within the pivoting portion 44 of the foot panel 34. As the foot panel 34 pivots downwardly, the first link 82 likewise pivots downwardly thereby extending the spring 50, as the portion 46 slides into the recess 48 of foot panel 34, and moving the foot end of the pivoting portion 44 downwardly away from the frame 18 until the foot panel 34 achieves the generally vertical attitude shown in FIG. 4C of the chair configuration of the bed 10 of this invention. In the chair configuration, the first link 82 and the second link 84 are in a generally vertical attitude as is the foot panel 34 with the collapsing portion 46 telescoped into the pivoting portion 44.

With the bed 10 converted to the chair configuration as shown in FIGS. 2, 4C, 8A and 8B, the portion 104 of mattress 20 is evacuated and a space is vacated at the foot end of the bed 10 permitting the patient 22 to egress from the bed 10. Advantageously, the retracted foot panel 34 is vertical thereby enabling the patient 22 to rest his feet directly on a floor surface underlying the bed 10 (FIG. 8A) and thereby avoiding confusion and inconvenience associated with the so-called "false floor" effect. Similarly, the foot guards 26, 26 in the chair configuration, the foot panel 34 in the retracted vertical attitude, and the U-shaped frame section 56 at the foot end of the bed 10 cooperate to vacate a space enabling patient egress from the bed 10 to a standing upright position. Similarly, a wheelchair, motorized scooter or motorized walker (not shown) can be docked into the vacated space at the foot end of the bed 10 of this invention thereby providing convenient transfer of the patient 22 from the bed 10 to the ambulatory assisting device.

Figure 9A:
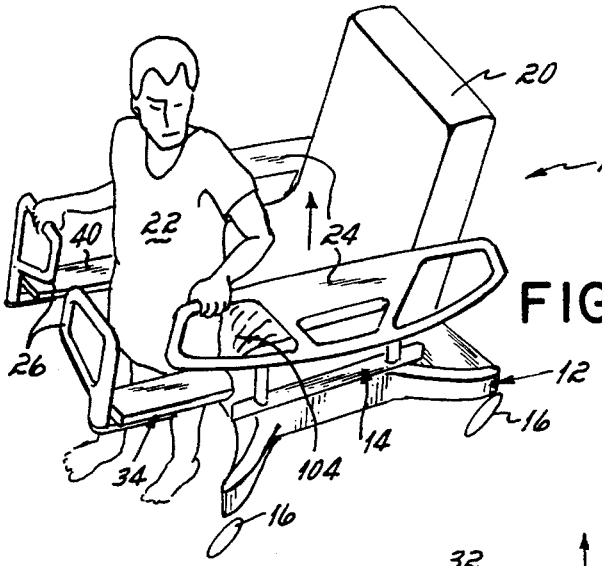
FIGS. 9A and 9B are views similar to FIGS. 8A and 8B, respectively, showing the patient lift mechanism raised to assist the patient exiting the bed.
Figure 9B:
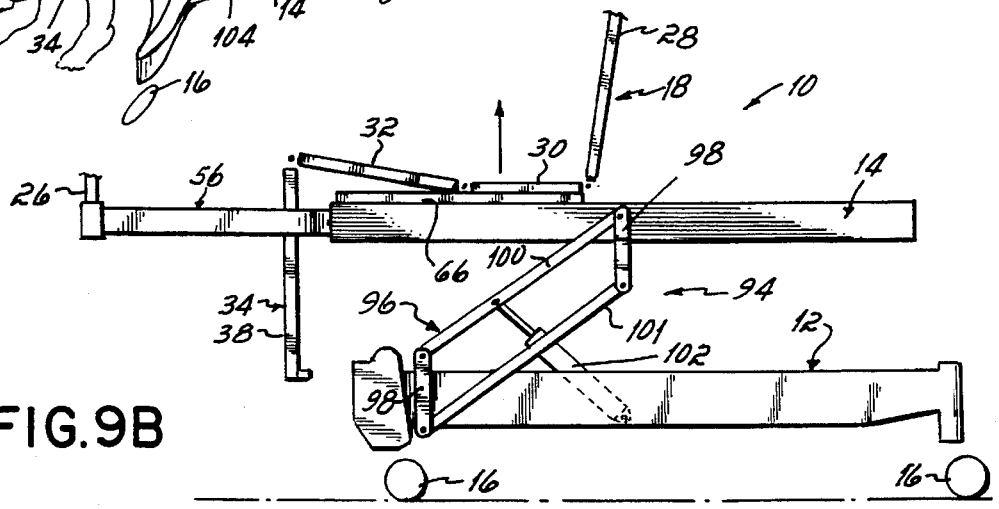

To assist the patient egress from the bed 10 in the chair configuration, the patient lift mechanism 94 is provided with this invention as shown in FIGS. 8A–B and 9A–B. The fourth hydraulic cylinder 102 extends as shown in FIG. 9B to pivot the four bar linkage 96 and raise the frame 18 relative to the base 12 and urge the patient 22 from a sitting position to a standing or upright position (FIG. 9A).

From the above disclosure and general principles of the present invention and the preceding detailed description of a preferred embodiment, those skilled in the art will readily comprehend the various modifications to which the present invention is susceptible. Therefore, we desire to be limited only by the scope of the following claims and equivalents thereof.

We claim:

1. A bed having a generally planar bed position and convertible to a chair position and permitting patient egress from the foot end thereof comprising:

a base;

a frame mounted on said base;

a patient support platform mounted on said frame and including at least head and foot panels;

said head panel being mounted for pivotal movement relative to said frame to a raised position when converting said bed to the chair position, said foot panel including a pivoting portion and a collapsing portion, said collapsing portion extending from and retracting toward said pivoting portion as said pivoting portion pivots upwardly and downwardly, respectively; and linkage connected between said frame and said platform for moving said platform longitudinally relative to said frame, pivoting said pivoting portion and collapsing said collapsing portion to convert said platform to and between the generally planar bed position and the chair position.

2. The bed of claim 1 wherein said collapsing portion telescopes into and out of said pivoting portion of said foot panel.

3. The bed of claim 1 wherein said collapsing portion is normally resiliently biased outwardly relative to said pivoting portion to extend toward the bed position.

4. The bed of claim 1 wherein said platform further includes seat and thigh panels, said head, seat, thigh and foot panels being serially hinged, said seat panel being maintained in a generally horizontal position, an interface between said foot and thigh panels being movable vertically, said foot panel further including lateral portions each being pivotally connected to said thigh panel, a head end of each said lateral portion moving upwardly with said thigh panel and a foot end of each said lateral portion remaining atop said frame as said central section of said foot panel drops below said frame into the chair position.

5. The bed of claim 4 wherein said frame includes a U-shaped section at a foot end of said bed, said U-shaped section having an open end thereof directed toward said foot end of said bed, said foot end of each said lateral portion of said foot panel being supported by an arm of said U-shaped section and said central portion of said foot panel dropping below said frame between said arms of said U-shaped section when in the chair position.

6. The bed of claim 1 wherein said linkage includes rollers mounted to one of said frame and said platform for rolling movement of said platform relative to said frame.

7. The bed of claim 6 wherein said rollers are mounted to said platform, said bed further comprising:

generally C-shaped channels secured to said frame, said rollers riding in said channels for longitudinal movement; and a piston and cylinder secured to said frame at a first end and to said platform at a second end for moving said platform longitudinally relative to said frame.

8. The bed of claim 1 wherein said linkage includes at least one link pivotally connecting said pivoting portion of said foot panel to said frame for pivoting said foot panel into a vertical position as said platform moves longitudinally toward a foot end of said bed.

9. The bed of claim 1 further comprising:

a block secured to said collapsing portion of said foot panel; and a roller mounted to said frame and cooperating with said block to retract said collapsing portion of said foot panel when said foot panel is pivoted to the chair position.

10. The bed of claim 1 further comprising:

a thigh panel connected to said foot panel at an interface; and a piston and cylinder connected at a first end to said frame and at a second end to said platform for raising and lowering said interface between said thigh and foot panels as said platform converts to and between the chair and bed positions, respectively.

11. The bed of claim 1 further comprising:

a U-shaped section forming a part of said frame at a foot end of said bed, said U-shaped section having a pair of arms and an open end thereof directed toward said foot end of said bed; and a footboard pivotally mounted at an outer end of each said arm of said U-shaped section, wherein said footboards may be pivoted to be generally collinear with each other when said bed is in the bed position thereby cooperating as a foot guard to provide protection to the patient at said foot end of said bed, and wherein said footboards may be pivoted to be generally parallel with each other on respective lateral sides of said bed when said bed is in the chair position for use by the patient in moving from an upright sitting position to a standing position to exit said bed from said foot end thereof.

12. A bed having a generally planar bed position and convertible to a chair position and permitting patient egress from the foot end thereof comprising:

a base;

a frame mounted on said base;

a patient support platform mounted on said frame and including at least head and foot panels;

said head panel being mounted for pivotal movement relative to said frame to a raised position when converting said bed to the chair position;

said foot panel including a pivoting portion and a collapsing portion, said collapsing portion extending from and retracting toward said pivoting portion as said pivoting portion pivots upwardly and downwardly, respectively; and said collapsing portion being normally resiliently biased outwardly relative to said pivoting portion to extend in the bed position.

13. The bed of claim 12 further comprising:

linkage connected between said frame and said platform for pivoting said pivoting portion and collapsing said collapsing portion to convert said platform to and between the generally planar bed position and the chair position.

14. The bed of claim 12 wherein said collapsing portion telescopes into and out of said pivoting portion of said foot panel.

15. The bed of claim 12 wherein said platform further includes seat and thigh panels, said head, seat, thigh and foot panels being serially hinged, said seat panel being maintained in a generally horizontal position, and an interface between said seat and thigh panels being movable vertically.

16. The bed of claim 15 wherein said frame includes a U-shaped section at a foot end of said bed, said U-shaped section having an open end thereof directed toward said foot end of said bed, said foot end of each said lateral portion of said foot panel being supported by an arm of said U-shaped section and said central portion of said foot panel dropping below said frame between said arms of said U-shaped section when in the chair position.

17. The bed of claim 16 wherein said linkage includes roller mounted to one of said frame and said platform for rolling movement of said platform relative to said frame and linkage between said frame and said platform for moving said foot panel into a vertical position as said platform moves longitudinally toward a foot end of said bed.

18. The bed of claim 17 wherein said rollers are mounted to said platform, said bed further comprising:

generally C-shaped channels secured to said frame, said rollers riding in said channels for longitudinal movement; and a piston and cylinder secured to said frame at a first end and to said platform at a second end for moving said platform longitudinally relative to said frame.

19. The bed of claim 17 wherein said linkage includes at least one link pivotally connecting said pivoting portion of said foot panel to said frame for pivoting said foot panel into a vertical position as said platform moves longitudinally toward a foot end of said bed.

20. The bed of claim 12 further comprising:

a block secured to said collapsing portion of said foot panel; and a roller mounted to said frame and cooperating with said block to retract said collapsing portion of said foot panel when said foot panel is pivoted to the chair position.

21. The bed of claim 12 further comprising:

a thigh panel connected to said foot panel at an interface; and a piston and cylinder connected at a first end to said frame and at a second end to said platform for raising and lowering said interface between said thigh and foot panels as said platform converts to and between the chair and bed positions, respectively.

22. The bed of claim 12 further comprising:

a U-shaped section forming a part of said frame at a foot end of said bed, said U-shaped section having a pair of arms and an open end thereof directed toward said foot end of said bed; and a footboard pivotally mounted at an outer end of each said arm of said U-shaped section, wherein said footboards may be pivoted to be generally collinear with each other when said bed is in the bed position thereby cooperating as a foot guard to provide protection to the patient at said foot end of said bed, and wherein said footboards may be pivoted to be generally parallel with each other on respective lateral sides of said bed when said bed is in the chair position for use by the patient in moving from an upright sitting position to a standing position to exit said bed from said foot end thereof.

23. A bed having a generally planar bed position and convertible to a chair position and permitting patient egress from the foot end thereof comprising:

a base;

a frame mounted on said base;

a patient support mounted on said frame and including at least head and foot panels, said head panel being mounted for pivotal movement relative to said frame for pivoting to a raised position and said foot panel being mounted for pivotal movement relative to said frame for pivoting to a lowered position when converting said bed to the chair position;

at least a portion of said foot panel being collapsible upon downward pivoting thereof so as to vacate said portion of said foot panel and prevent interference between said foot panel and a bed supporting floor when converting said bed to the chair position when said frame is lowered to a lowermost position thereby permitting said frame to be lowered to a lowermost position so that a patient's feet rest directly on the floor allowing the patient to egress from the foot end of said bed when in the chair position;

a U-shaped section forming a part of said frame at a foot end of said bed, said U-shaped section having a pair of arms and an open end thereof directed toward said foot end of said bed; and a footboard pivotally mounted at an outer end of each said arm of said U-shaped section, wherein said footboards may be pivoted to be generally collinear with each other when said bed is in the bed position thereby cooperating as a foot guard to provide protection to the patient at said foot end of said bed, and wherein said footboards may be pivoted to be generally parallel with each other on respective lateral sides of said bed when said bed is in the chair position for use by the patient in moving between an upright sitting position and a standing position.

24. The bed of claim 23 wherein said foot panel includes a central foot panel section having a pivoting portion and a collapsing portion, said collapsing portion extending from and retracting toward said pivoting portion as said pivoting portion pivots downwardly and upwardly, respectively, to convert said platform to and between the generally planar bed position and the chair position, respectively.

25. The bed of claim 24 further comprising:

linkage connected between said frame and said platform for moving said platform longitudinally relative to said frame, pivoting said pivoting portion and collapsing said collapsing portion to convert said platform to and between the generally planar bed position and the chair position.

26. The bed of claim 24 wherein said platform further includes seat and thigh panels, said head, seat, thigh and foot panels being serially hinged, said seat panel being maintained in a generally horizontal position, an interface between said foot and thigh panels being movable horizontally, said foot panel further including lateral portions each being pivotally connected to said thigh panel, a head end of each said lateral portion moving upwardly with said thigh panel and a foot end of each said lateral portion remaining atop said frame as said central section of said foot panel drops below said frame into the chair position.

27. The bed of claim 26 wherein said frame includes a U-shaped section at a foot end of said bed, said U-shaped section having an open end thereof directed toward said foot end of said bed, said foot end of each said lateral portion of said foot panel being supported by an arm of said U-shaped section and said central portion of said foot panel dropping below said frame between said arms of said U-shaped section when in the chair position.

28. The bed of claim 25 wherein said linkage includes rollers mounted to one of said frame and said platform for rolling movement of said platform relative to said frame for moving said foot panel into a vertical position as said platform moves longitudinally toward a foot end of said bed.

29. The bed of claim 28 wherein said rollers are mounted to said platform, said bed further comprising:

generally C-shaped channels secured to said frame, said rollers riding in said channels for longitudinal movement; and a piston and cylinder secured to said frame at a first end and to said platform at a second end for moving said platform longitudinally relative to said frame.

30. The bed of claim 29 wherein said linkage includes at least one link pivotally connecting said pivoting portion of said foot panel to said frame for pivoting said foot panel into a vertical position as said platform moves longitudinally toward a foot end of said bed.

31. The bed of claim 23 further comprising:

a thigh panel connected to said foot panel at an interface; and a piston and cylinder connected at a first end to said frame and at a second end to said platform for raising and lowering said interface between said thigh and foot panels as said platform converts to and between the chair and bed positions, respectively.

32. A bed having a generally planar bed position and convertible to an egress position permitting egress from a foot end of the bed comprising:

a base;

a frame mounted on said base;

a patient support platform mounted said frame and including a foot panel having generally horizontal up positions and a generally vertically downwardly extending down position;

a mattress overlying said platform and including a selectively deflatable foot portion which may be deflated without changing any other portion of said mattress;

whereby said bed assumes the egress position upon said foot panel assuming said down position and deflation of said deflatable portion of said mattress.

33. The bed of claim 32 wherein said frame includes a U-shaped section at a foot end of said bed, said U-shaped section having an open end thereof directed toward said foot end of said bed; and said foot panel is pivotally mounted relative to said frame to pivot downwardly through said U-shaped section.

34. The bed of claim 32 wherein said foot panel includes a pivoting portion and a collapsing portion, said collapsing portion extending from and retracting toward said pivoting portion as said pivoting portion pivots upwardly and downwardly, respectively.

35. The bed of claim 34 wherein said collapsing portion telescopes into and out of said pivoting portion of said foot panel.

36. The bed of claim 34 wherein said collapsing portion is normally resiliently biased outwardly relative to said pivoting portion to extend toward the bed position.

37. The bed of claim 36 further comprising:

a block secured to said collapsing portion of said foot panel; and a roller mounted to said frame and cooperating with said block to retract said collapsing portion of said foot panel when said foot panel is pivoted to the chair position.

38. The bed of claim 32 wherein said frame further includes a thigh panel pivotally connected to said foot panel at an interface and said interface raises and lowers as said platform converts to and between the chair and bed positions, respectively.

39. The bed of claim 38 wherein said frame further includes a seat panel maintained in a generally horizontal position and said thigh panel is pivotally connected to said seat panel.

40. A hospital bed comprising:

a base;

a frame mounted on said base; and a patient support platform mounted on said frame;

said frame including a U-shaped section at a foot end of said bed, said U-shaped section having an open end thereof directed toward said foot end of said bed;

said patient support platform including a foot panel having a central portion and lateral portions all said portions being pivotally mounted relative to said frame, said central portion pivoting downwardly through said U-shaped section and said lateral portions residing atop arms of said U-shaped section.

41. A bed comprising:

a base;

a frame mounted on said base, said frame including a U-shaped section at a foot end of said bed and said U-shaped section having an open end thereof directed toward said foot end of said bed;

a patient support platform mounted on said frame, said patient support platform including a foot panel pivotally mounted relative to said frame to pivot downwardly through said U-shaped section; and a footboard pivotally mounted to said U-shaped section at said foot end of said bed on either lateral side thereof, wherein said footboards may be pivoted to be generally collinear with each other thereby cooperating as a foot guard to provide protection to the patient at said foot end of said bed, and wherein said footboards may be pivoted to be generally parallel with each other on respective lateral sides of said bed for use by a patient in moving between an upright sitting position and a standing position.

42. A bed having a generally planar bed position and convertible to a chair position comprising:

a base;

a frame mounted on said base;

a patient support platform mounted on said frame and including an upwardly pivoting head panel and a downwardly pivoting foot panel; and a mattress overlying said platform and including a selectively deflatable foot portion which may be deflated without changing any other portion of said mattress;

whereby said bed assumes the chair position upon upward pivoting of said head panel, downward pivoting of said foot panel and deflation of said deflatable portion of said mattress.

43. The bed of claim 42 wherein said foot panel includes a pivoting portion and a collapsing portion, said collapsing portion extending from and retracting toward said pivoting portion as said pivoting portion pivots upwardly and downwardly, respectively.

44. The bed of claim 42 wherein said frame further includes a thigh panel pivotally connected to said foot panel at an interface and said interface raises and lowers as said platform converts to and between the chair and bed positions, respectively.

45. The bed of claim 44 wherein said frame further includes a seat panel maintained in a generally horizontal position and said head and thigh panels are pivotally connected to said seat panel.

46. A method of patient egress from a foot end of a bed converted to a chair comprising the steps of:

providing a hospital bed with a base, a frame mounted for vertical movement relative to said base, a patient support platform mounted on said frame and including an upwardly pivoting head panel and a downwardly pivoting foot panel, and a guard mounted on either side of said frame near a foot end thereof;

lowering said frame to a lowermost position;

pivoting said head panel upwardly;

pivoting said foot panel downwardly and collapsing said foot panel to vacate a portion of said foot panel and prevent interference between said foot panel and the floor;

positioning the patient's feet directly on the floor;

positioning the patient's hands so as to grasp said guards to assist the patient in beginning to rise from a seated position; and raising said bed frame upwardly to assist the patient in rising to a standing position and egressing from the bed.

47. A bed comprising:

a base;

a frame mounted on said base;

a patient support platform mounted on said frame and including an upwardly pivoting head panel and a foot panel;

said foot panel including a downwardly pivoting portion, lateral portions and a translating portion:

said translating portion translating away from and toward said pivoting portion and in a plane generally parallel a plane defined by said pivoting portion as said pivoting portion pivots upwardly and downwardly, respectively; and said pivoting and translating portions being lowerable below said frame and said lateral portions being supported atop said frame.

48. The bed of claim 47 wherein said foot panel pivoting and translating portions telescope relative to one another.

* * * * *